US011399634B2

(12) United States Patent
Aramli

(10) Patent No.: US 11,399,634 B2
(45) Date of Patent: Aug. 2, 2022

(54) MATTRESS COVER THAT FORMS A RECESSED CAVITY UNDERNEATH A MATTRESS AND METHOD OF ASSEMBLY OF THE MATTRESS COVER

(71) Applicant: BEDJET LLC, Newport, RI (US)

(72) Inventor: Mark Darius Aramli, Newport, RI (US)

(73) Assignee: BedJet LLC, Newport, RI (US)

( * ) Notice: Subject to any disclaimer, the term of this patent is extended or adjusted under 35 U.S.C. 154(b) by 0 days.

(21) Appl. No.: 17/512,353

(22) Filed: Oct. 27, 2021

(65) Prior Publication Data

US 2022/0104630 A1 Apr. 7, 2022

Related U.S. Application Data

(63) Continuation-in-part of application No. 17/061,656, filed on Oct. 2, 2020, now Pat. No. 11,291,308.

(51) Int. Cl.

| | |
|---|---|
| ***A47C 27/00*** | (2006.01) |
| ***A47C 21/02*** | (2006.01) |
| ***A47C 23/00*** | (2006.01) |

(52) U.S. Cl.

CPC ..... *A47C 27/002* (2013.01); *A47C 21/026* (2013.01); *A47C 23/002* (2013.01); *A47C 23/007* (2013.01); *A47C 27/00* (2013.01)

(58) Field of Classification Search

CPC ..... A61G 7/015; A47C 27/001; A47C 27/00; A47C 27/002; A47C 21/026; A47C 23/002; A47C 20/041; A47C 31/105

See application file for complete search history.

(56) References Cited

U.S. PATENT DOCUMENTS

| | | | | |
|---|---|---|---|---|
| 6,516,481 | B1 * | 2/2003 | Erickson | A47C 27/144 5/724 |
| 6,742,205 | B2 * | 6/2004 | Dewert | A47C 27/20 5/616 |
| D593,349 | S | 6/2009 | Pittman | |
| 8,561,235 | B2 * | 10/2013 | Oh | A47C 21/022 5/722 |
| 94,334,546 | | 9/2016 | Rawls-Meehan | |
| 10,376,074 | B2 | 8/2019 | Aramli | |
| 10,463,153 | B2 | 11/2019 | Aramli | |
| 10,463,163 | B1 | 11/2019 | Aramli | |
| 10,863,830 | B2 * | 12/2020 | Dewert | A47C 27/053 |
| 10,925,409 | B1 * | 2/2021 | Aramli | A47C 21/06 |
| 11,291,308 | B1 * | 4/2022 | Aramli | A47C 27/146 |
| 2002/0152552 | A1 * | 10/2002 | Dewert | A47C 23/06 5/722 |

(Continued)

OTHER PUBLICATIONS

U.S. Appl. No. 17/061,656, Aramli, Claims.

*Primary Examiner* — David R Hare

(74) *Attorney, Agent, or Firm* — Robert J. Hess; Hess Patent Law Firm

(57) ABSTRACT

A method of assembly and a product upon which a person may lie down that includes a mattress cover fitted onto a mattress cover to envelop same. The underside of the mattress cover has a projecting lip that bounds a recessed cavity that accommodates an adjustable mechanism, which is actuated to raise of lower head or foot portions of the mattress. The lip contains filler material such a foam and overlaps sides of the adjustable mechanism to conceal same.

20 Claims, 15 Drawing Sheets

(56) References Cited

U.S. PATENT DOCUMENTS

| | | | | |
|---|---|---|---|---|
| 2003/0135930 | A1* | 7/2003 | Varese | A47C 27/148 5/722 |
| 2005/0011005 | A1 | 1/2005 | Borda | |
| 2011/0247144 | A1* | 10/2011 | Oh | A47C 20/041 5/737 |
| 2014/0366267 | A1 | 12/2014 | Such | |
| 2015/0208813 | A1 | 7/2015 | Heeke | |
| 2018/0125250 | A1 | 5/2018 | Dewert | |
| 2019/0298074 | A1 | 10/2019 | Dan-On | |

* cited by examiner

MATTRESS COVER THAT FORMS A RECESSED CAVITY UNDERNEATH A MATTRESS AND METHOD OF ASSEMBLY OF THE MATTRESS COVER

CROSS-REFERENCE TO RELATED APPLICATIONS

U.S. patent application Ser. No. 17/061,656 filed Oct. 2, 2020.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of Endeavor to which the Invention Pertains

The invention pertains to a mattress cover for a mattress, whose underside has a lip that defines a recess cavity that accommodates an adjustable power bed layer or adjustable bed lift mechanism. The lip may have a gap through which extends a power cord to power the adjustable power bed layer or adjustable bed lift mechanism.

2. Description of Information Known to the Inventor, Including References to Specific Documents Related to the Invention, and Specific Problems Involved in the State of Technology that the Invention is Drawn Toward Adjustable bed frames, also called power adjustable bases or power beds, have become a commonplace convenience in bedrooms. The ability to raise and lower the head and legs elevations in beds have many proven benefits and comfort qualities. Typical power adjustable bed frames can lift anywhere from 450 to 800 pounds of evenly distributed weight in a bed.

The present inventor devised a mattress whose underside has a perimeter wall or a peripheral flange that partially bounds a recessed cavity, as disclosed in U.S. Pat. No. 10,925,409 B1, whose contents are incorporated herein by reference, so as to accommodate, within confines of the recessed cavity, the adjustable power bed layer of U.S. Pat. No. 10,463,163 B1, whose contents are incorporated herein by reference, or the adjustable bed lift mechanism of U.S. Pat. No. 10,376,074 B2, whose contents are incorporated herein by reference.

It is desired to provide a mattress cover fitted onto a mattress to form a recessed cavity beneath the mattress to partially bound within the recessed cavity an adjustable mechanism, namely, the adjustable power bed layer or the adjustable bed lift mechanism.

SUMMARY OF THE INVENTION

One aspect of the invention relates to a mattress cover that fits onto a mattress and that forms sidewalls of a recessed cavity beneath the mattress. In its flattened, unfolded condition, an adjustable mechanism (e.g., the power bed layer of U.S. Pat. No. 10,463,163 B1 or the adjustable bed lift mechanism of U.S. Pat. No. 10,376,074 B2) is fitted into the recessed cavity and thus partially concealed from view by a lip of the mattress cover that projects from outer regions of the mattress cover to overlap with sides of the adjustable mechanism. When actuated, the adjustable mechanism angles the head or foot regions of the mattress relative to a central region of the mattress that separates the head and foot regions from each other by raising or lowering the head or foot regions as the case may be.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
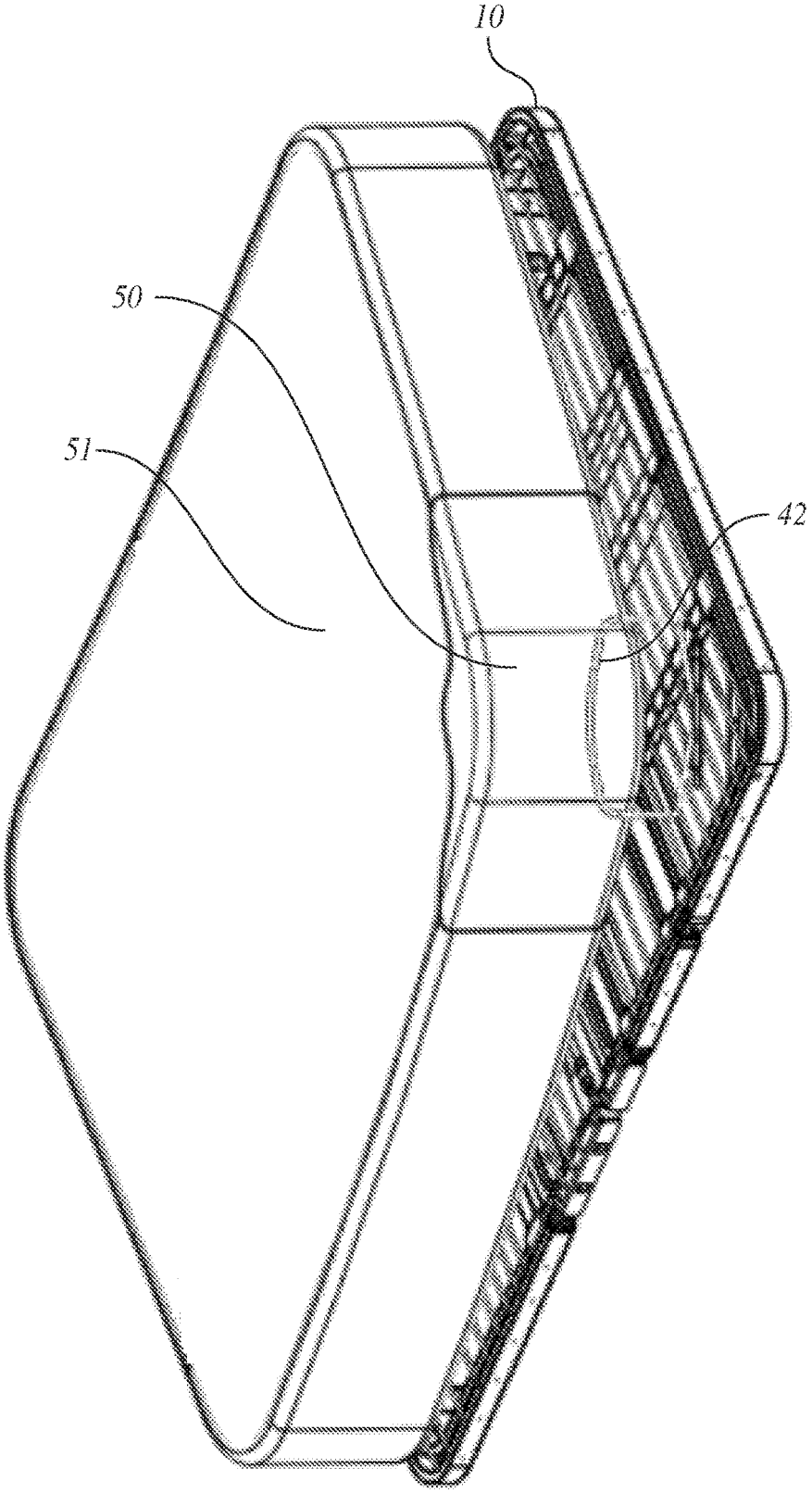
FIG. 1 (PRIOR ART)
FIG. 1 is an isometric view of a conventional mattress being placed upon an adjustable mechanism as shown in FIG. 27 of U.S. Pat. No. 10,463,163, B1.
Figure 2:
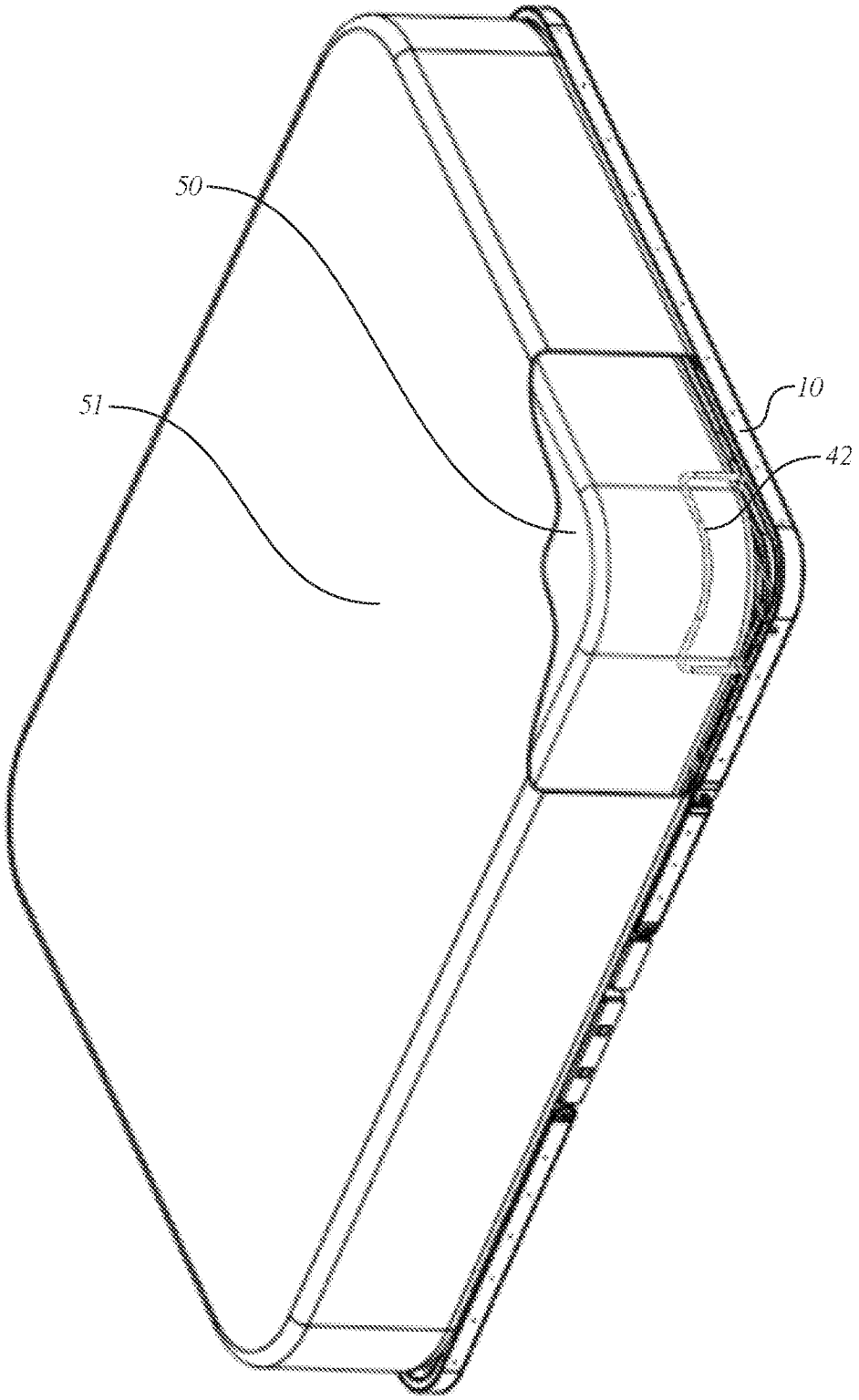
FIG. 2 (PRIOR ART)
FIG. 2 is a schematic representation of a side view of the mattress being placed upon the adjustable mechanism of FIG. 1.

Turning to the drawings, FIG. 1 and FIG. 2 show a conventional adjustable mechanism underneath a conventional mattress in accord with the adjustable power bed layer/base of FIG. 27 and FIG. 28 of U.S. Pat. No. 10,463,163 B1, whose contents are incorporated herein by reference, or the adjustable bed lift mechanism of U.S. Pat. No. 10,376,074 B2, whose contents are incorporated herein by reference. For the sake of convenience, an "adjustable mechanism 10" as set forth herein will collectively refer to the adjustable power bed layer/base of U.S. Pat. No. 10,463,163 B1 as well as to the adjustable bed lift mechanism of U.S. Pat. No. 10,376,074 B2, or any other thin profile adjustable lifting mechanism. Also, a "mattress 50" as set forth herein refers to any conventional mattress.

A conventional mattress cover 51 envelops the mattress 50, but with its corner region removed in FIG. 1 for the sake of clarity to reveal the mattress 50 underneath. Conventional retainer bars 42 are positioned against the mattress 50. FIG. 2 shows the mattress 50 upon a adjustable mechanism 10 with the side of the adjustable mechanism 10 visible beneath the mattress 50 and thus not hidden from view when viewed from the side.

The adjustable mechanism 10 of FIGS. 1 and 2 may have an adjustable bed frame with two articulating frames each pivotally movable between flattened and adjusted orientations and separated from each other with a central frame interposed between the two articulating frames. There are two actuators that drive two sliding members respectively to undertake respective sliding back and forth motions and has two connected structures pivotally connecting the two sliding members respectively with respective ones of the two articulating frames to move in unison with the sliding back and forth motions of the two sliding members respectively to thereby pivot the two articulating frames to move between the flattened and adjusted orientations as the central frame remains stationary throughout an entirety of the sliding back and forth motions of the two sliding members wherein the sliding members slide away from the center frame to the flattened orientation and slide towards the center frame to the adjusted orientation.

Alternatively, the adjustable mechanism 10 may include a frame having a fixed portion and having an articulating portion pivotally connected to the fixed portion so that as the articulating portion pivots relative to the fixed portion, an angle of inclination changes between the articulating portion and the fixed portion. Also, there are a plurality of lift mechanisms that actuate successively to exert a respective lifting force on the articulating portion to widen the angle of inclination in succession. An actuator connected structure is provided that moves relative to the fixed portion of the bed frame from a non-actuated position to successive actuated positions where the actuator connected structure triggers successive ones of the lift mechanisms to impart the respective lifting force on the articulating portion accordingly.

Figure 3:
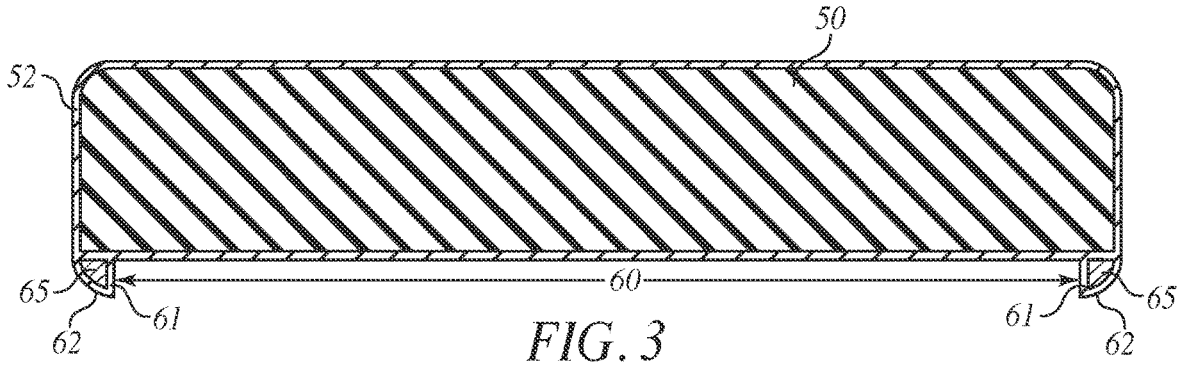
FIG. 3 is a cross-section of a mattress equipped with a mattress cover in accordance with the invention that has a lip projecting outward to bound a recessed cavity by serving as a perimeter wall or peripheral flange.
Figure 4:
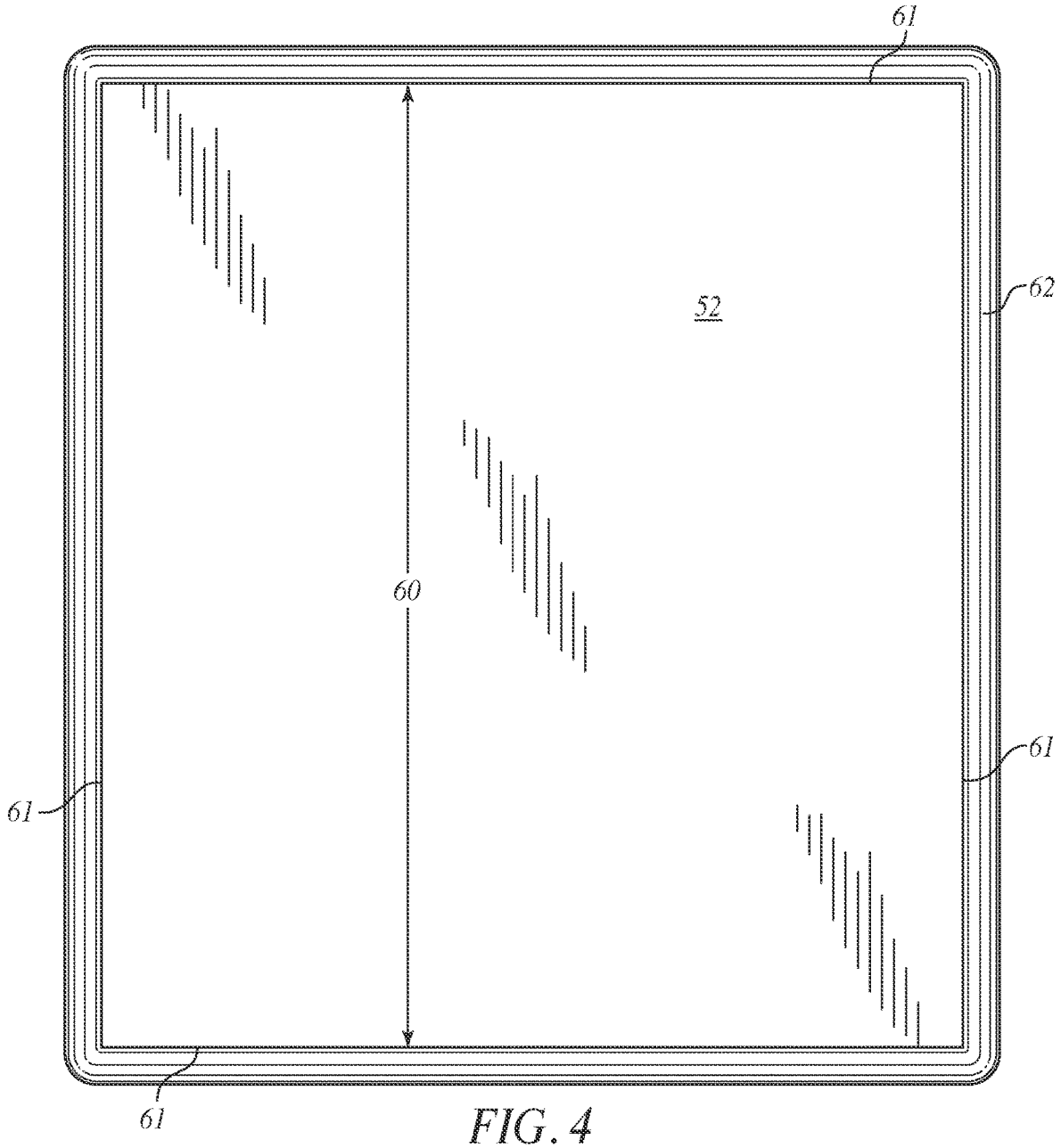
FIG. 4 is a bottom view of the mattress cover of FIG. 3.

FIGS. 3 and 4 show a mattress cover 52 in accordance with the invention fitted onto the mattress 50 of FIGS. 1 and 2 to envelope the mattress 50. The mattress cover 52 may be made of a fabric material such as cotton, linen, *eucalyptus* tree wood pulp, bamboo, polyester, woven microfiber, nylon, acrylic, or blends, such as cotton/polyester, cotton/bamboo, cotton/rayon, or nylon/polyester. The mattress cover 52 is formed in the same manner that the conventional mattress cover 52 of FIGS. 1 and 2 is formed except that a lip 62 containing filler material 65 is provided also at the outer peripherals regions of the underside of the mattress cover 52.

That is, the mattress cover 52 has outer peripheral regions from which project outward the lip 62. The lip 62, together with the underside of the mattress cover 52, bounds the recessed cavity 60. The mattress cover 52 has a fabric layer that envelops the mattress 60 and that bounds a peripheral contour of the lip 62. The fabric layer defines a cavity within the lip in which is contained the filler material 65, which is in contact with the fabric layer of the mattress cover 52.

The filler material 65 may be foam, which could be shaped or cut into strips or blocks. The filler material 65 is flexible and preferably of the same stiffness as the base foam of a conventional mattress. Such base foam flexes—the head and foot regions of the conventional mattress that contain such a base foam flex in response to forces imposed from an underlying adjustable lift mechanism urging the head and foot regions to move relative to the central region of the mattress that separates the head and foot regions from each other.

Figure 5:
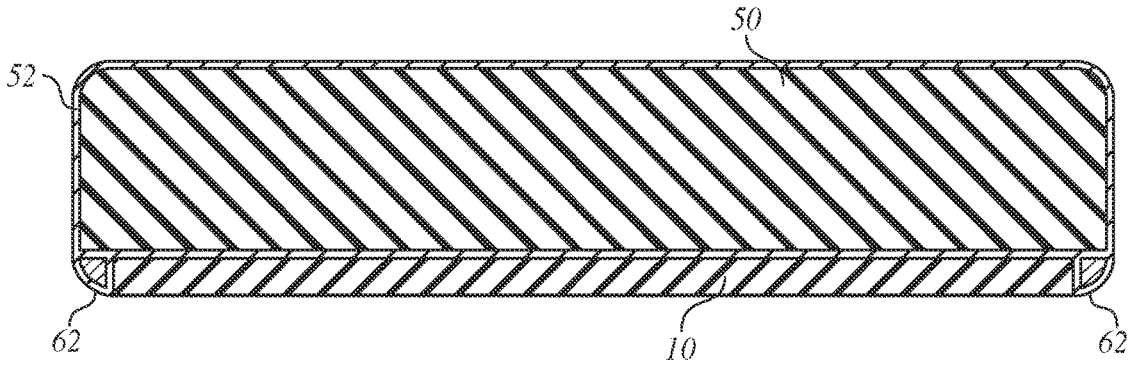
FIG. 5 is a cross-section of the mattress equipped with the mattress cover of FIG. 3 into whose recessed cavity is fitted the adjustable mechanism.
Figure 8:
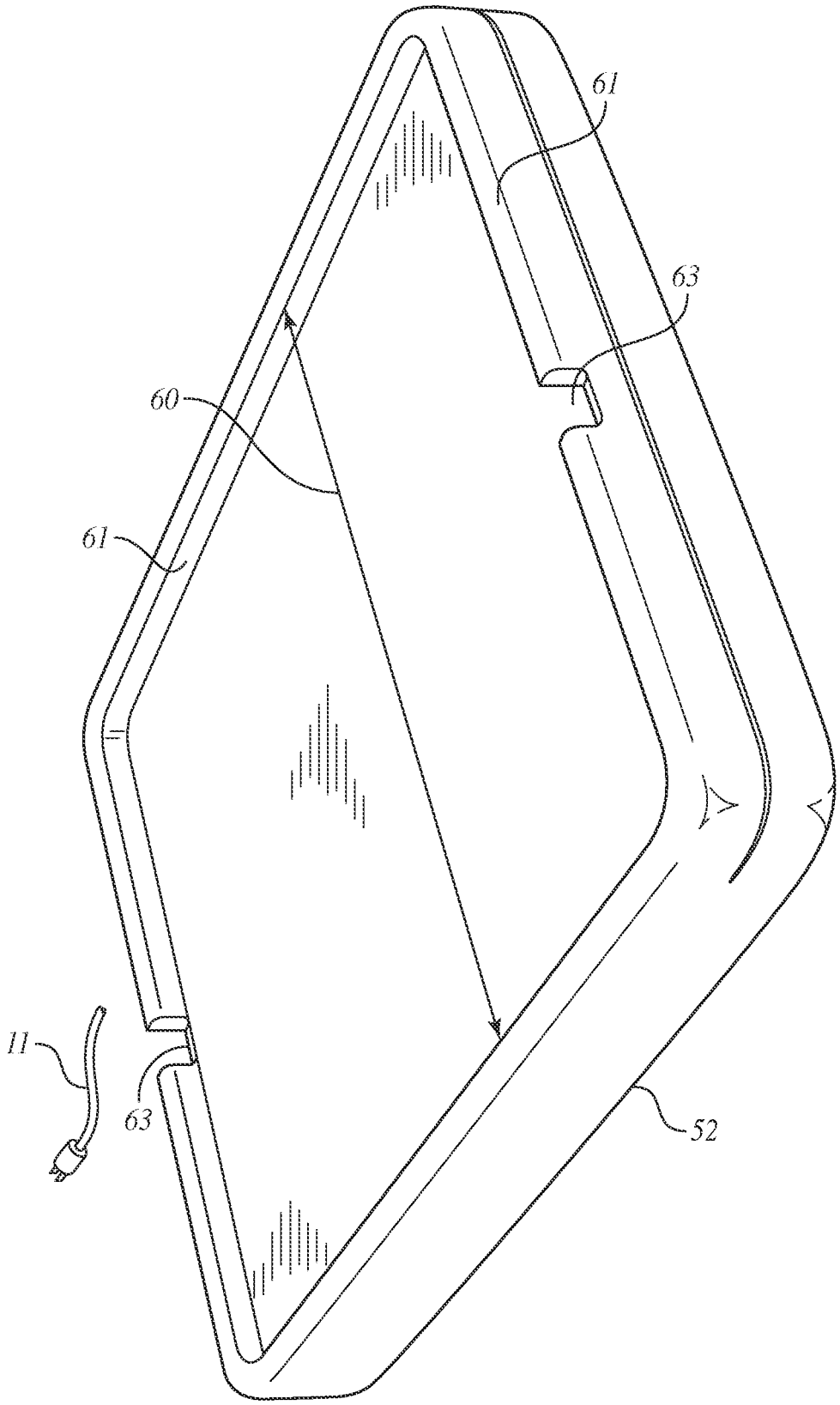
FIG. 8 is an isometric view of the bottom, side and end of a mattress equipped with a mattress cover of the present invention.

Turning to FIG. 5, by accommodating the adjustable mechanism 10 within the recessed cavity 60, concealment of the adjustable mechanism 10 results from overlapping portions of the lip 62, which bounds the recessed cavity 60. Preferably, the lip 62 projects outward by a uniform distance from the underside of the mattress 50 except where gaps or openings 63 in the perimeter wall may be required, as shown in FIG. 8, at the head and foot sides of the mattress 50.

Each of the openings or gaps 63 should be at least wide enough to accommodate placement of a DC power cord 11 to extend through for powering the adjustable mechanism 10 by conveying electricity according. For that reason, the DC power cord 11 extends from within the recessed cavity 60 to outside the recessed cavity 60.

The reason the two openings or gaps 63 are at the head and foot side of the mattress cover 52 is to allow for rotation of the mattress 50 over time due to wear between the foot and head sides as is common practice for mattresses over the course of years. If there is a bed frame present that has a conventional headboard and a conventional footboard of a bed frame present, then the opening or gap 63 could really extend the full widthwise distance of the head and foot ends of the mattress 50, because each opening or gap 63 would in effect be blocked from view by the conventional headboard and the conventional footboard of the bed frame.

The recessed cavity 60 is dimensioned to snugly fit therein the adjustable mechanism 10 in its flattened, unfolded condition and thus overlaps the sides of the adjustable mechanism 10 in its flattened, unfolded orientation to conceal the sides from view.

Even if the lip 62 only extended about the periphery of the underside of the mattress along the foot facing side and adjacent two sides of the mattress (but not along the head facing side), the adjustable mechanism 10 would still be in effect concealed from view in its flattened, unfolded condition. This is because the widthwise head end of a mattress 50 typically has a headboard that would block one's view of the underside of the mattress 50 from the head end. Even if there is no headboard, then the head end of the mattress 50 is typically positioned adjacent a bedroom wall and thus the bedroom wall would block one's view of the underside of the mattress.

In the case where the bed frame also has a footboard, the footboard would block one's view of the underside of the mattress 50 from the widthwise foot end so in that case the lip 62 would not need to extend along the foot end to conceal from view the adjustable mechanism 10.

Figure 6:
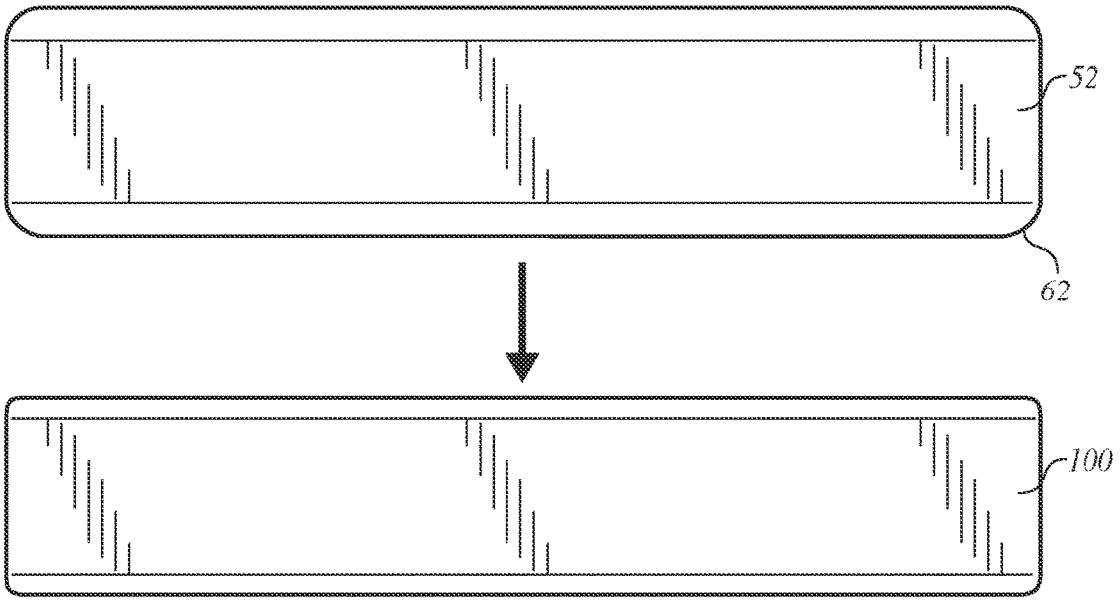
FIG. 6 is a side view of FIG. 5 with the adjustable mechanism hidden from view from the side by the lip of the mattress cover and showing a box spring, upon which the mattress cover is fitted.
Figure 7:
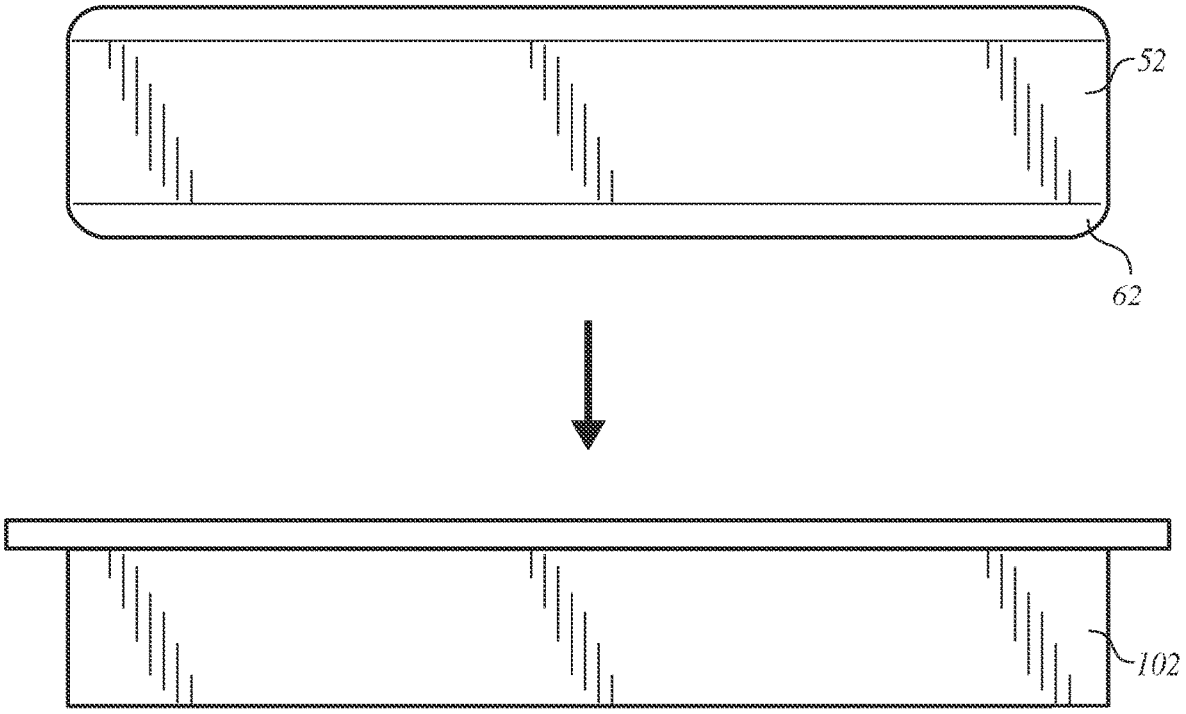
FIG. 7 is a side view of FIG. 5 with the adjustable mechanism hidden from view from the side by the lip of the mattress cover upon a platform bed base.

Turning to FIGS. 6 and 7, the adjustable mechanism 10 in its flattened, unfolded condition is placed on a box spring 100 of FIG. 6 or the platform bed base 102 of FIG. 7 or any other conventional bed frame. With the mattress cover 52 fitted onto the mattress 50 to envelope same, the recessed cavity 60 is positioned to accommodate within the adjustable mechanism 10 so that the lip 62 overlaps sides of the adjustable mechanism 10 to conceal same. The adjustable mechanism abuts the portion of the fabric layer of the mattress cover 52 that is beneath the underside of the mattress and that bounds the recessed cavity at a location inward from the lip 62.

Figure 9:
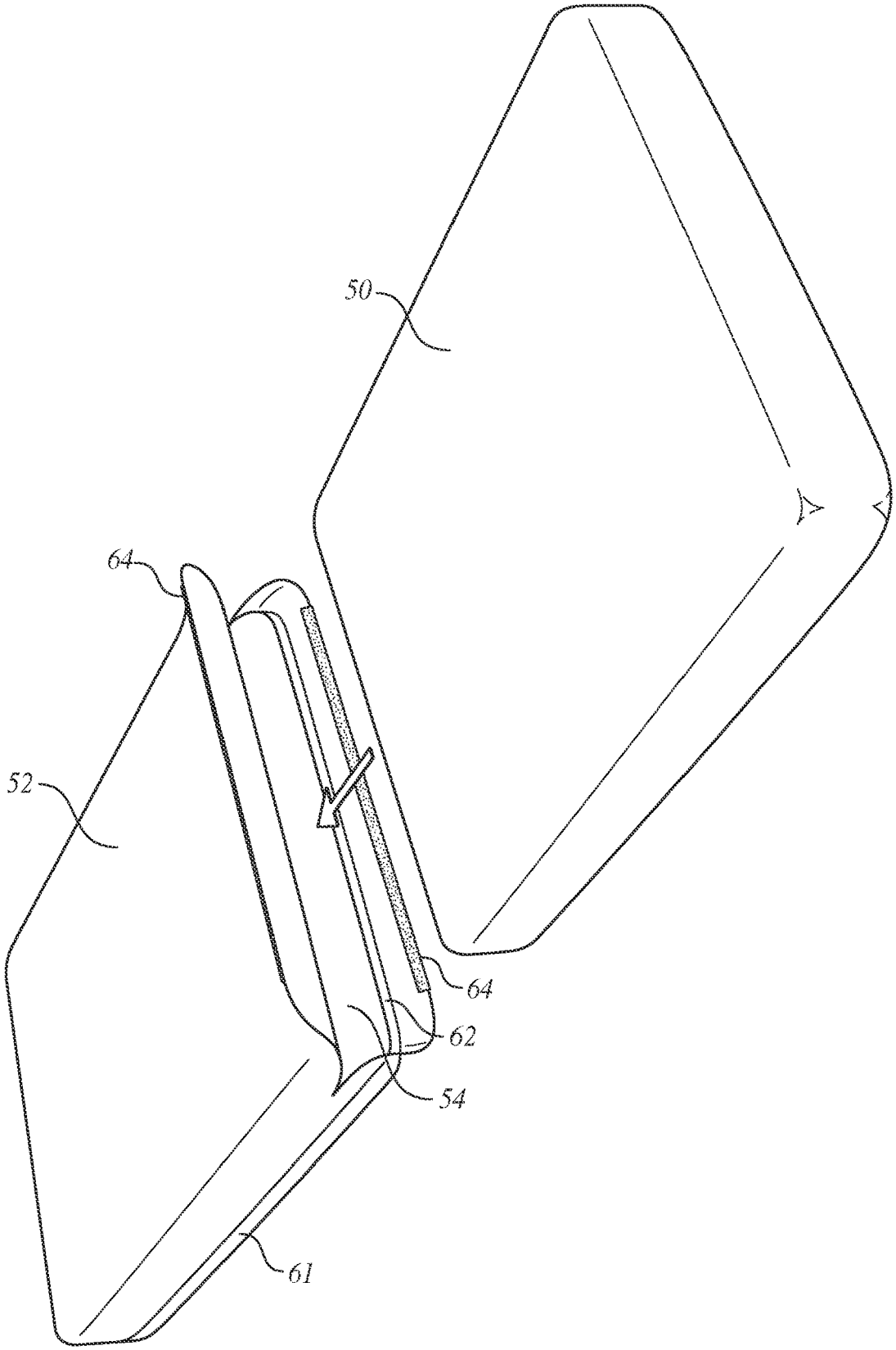
FIG. 9 is an isometric view of the top, side and end of a mattress being inserted within the mattress cover in accordance with an embodiment the present invention.

The mattress cover 52 may be in the form of the sleeve 56 of FIG. 9 that has an end opening 54 that can be opened or closed by fastening together hook and loop fasteners 64 or alternatively by zippering with a zipper that slides to mesh or separate zipper teeth (not shown but in accord with conventional zippering techniques) instead of providing for the hook and loop fasteners 64.

Figure 10:
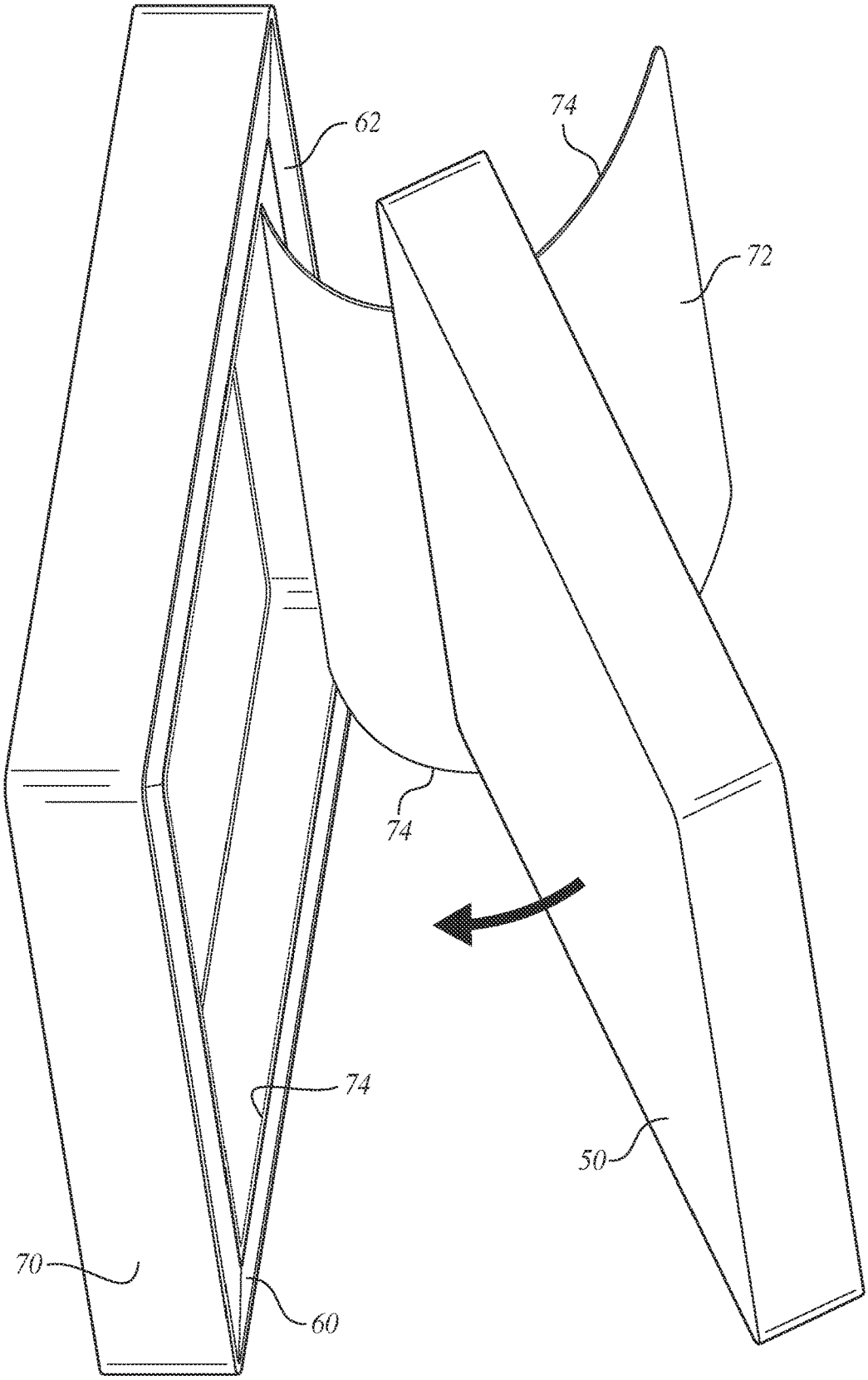
FIG. 10 is an isometric view of the bottom, side and end of a conventional mattress being inserted with the mattress cover in accordance with a further embodiment of the present invention.
Figure 11:
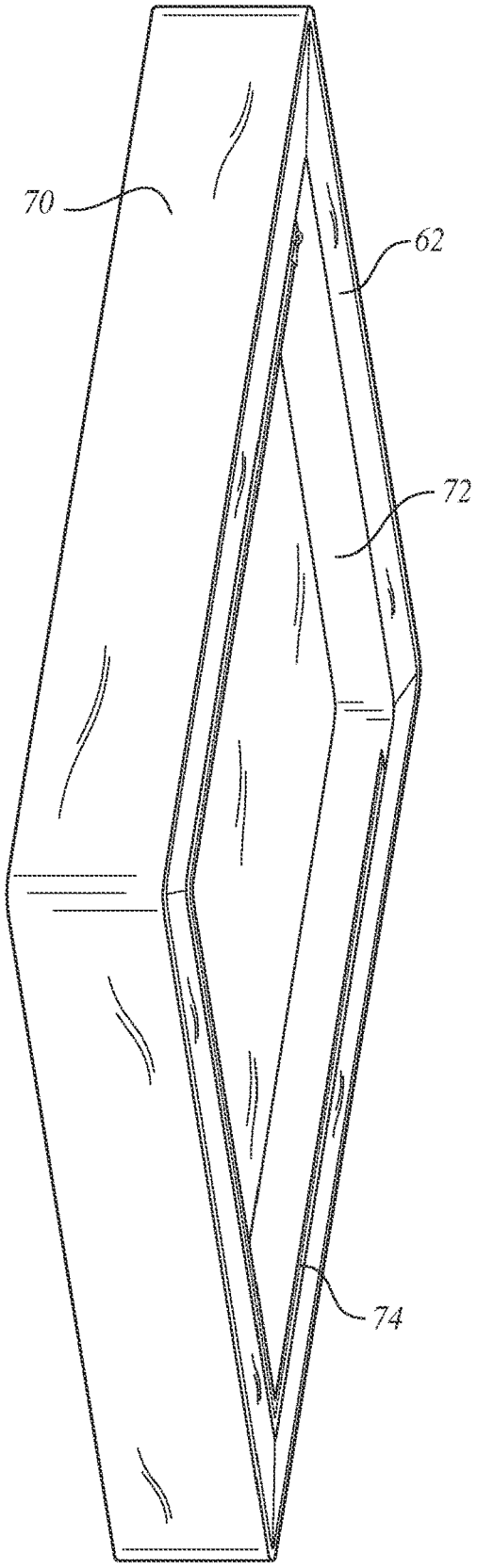
FIG. 11 is an isometric view of the mattress cover of FIG. 10 enclosing the mattress inside.
Figure 12:
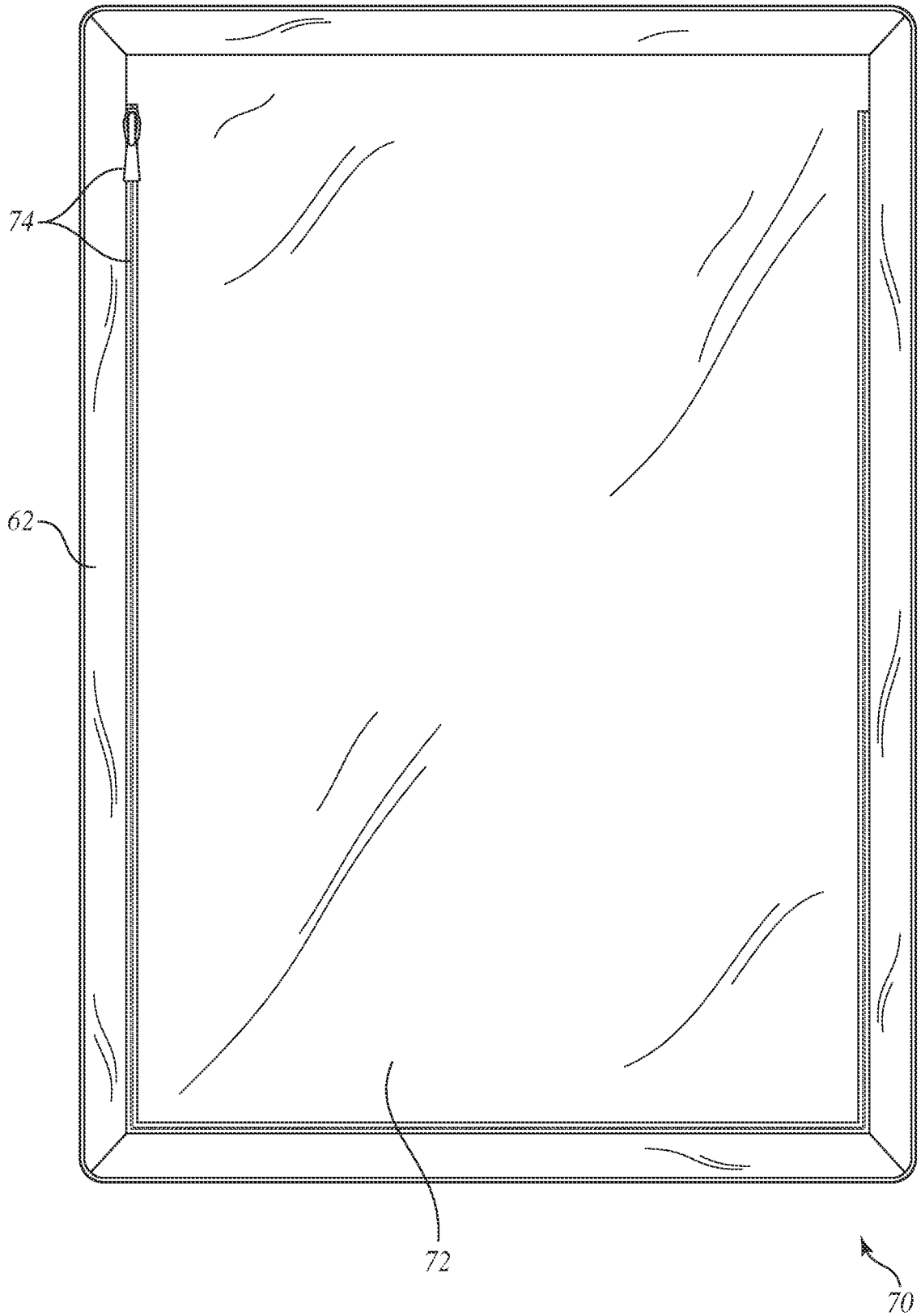
FIG. 12 is an underside view of FIG. 11.
Figure 13:
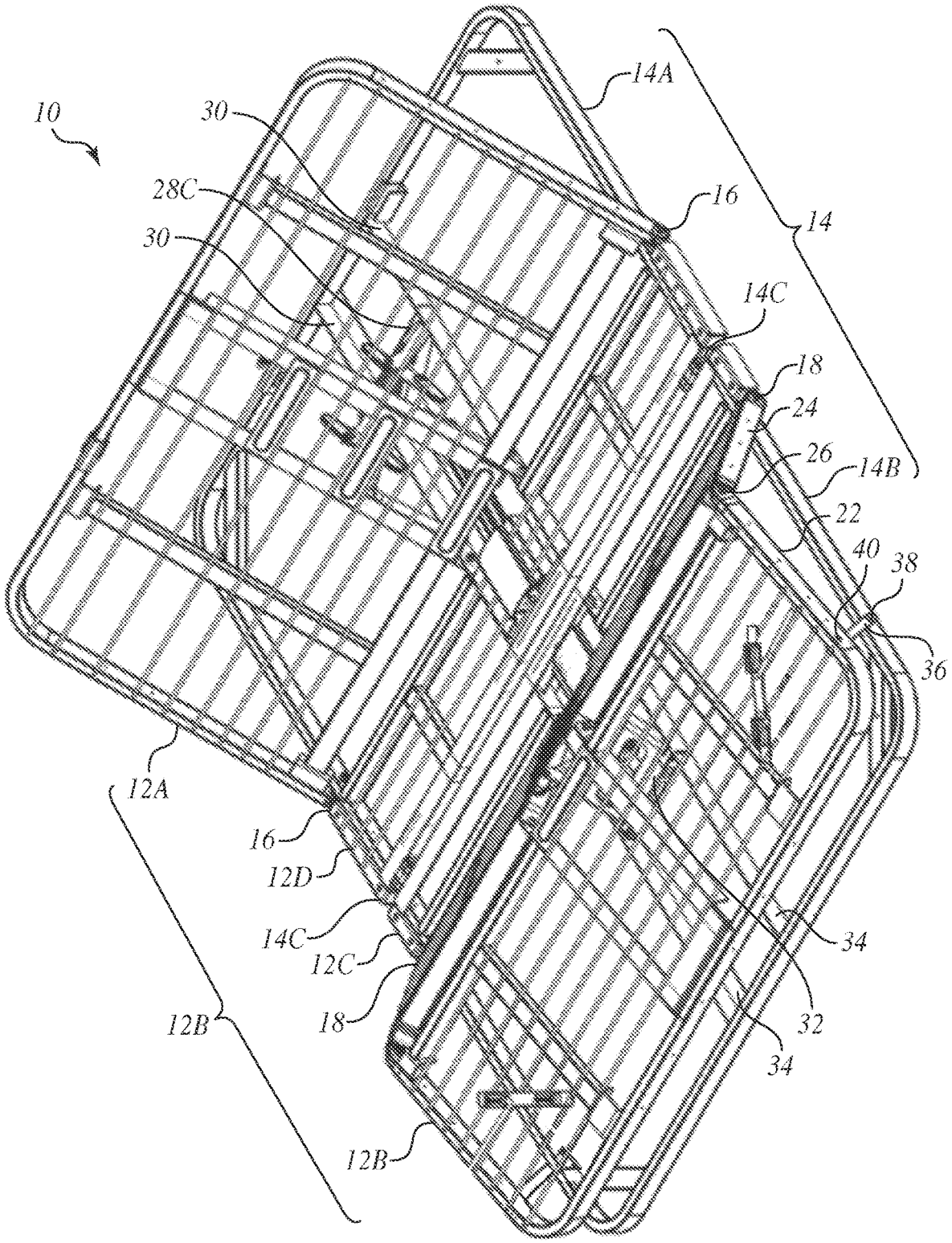
FIG. 13 is an isometric view of the adjustable power bed layer/base in an adjusted state.

Alternatively, the mattress cover 52 may be in the form of the enclosure 70 of FIGS. 10-12 that has an underside panel 72 that can be opened or closed by a fastener, such as a zipper 74 that is recessed relative to the lip 62. The zipper 74 is of conventional construction and includes chain teeth, a slider body and a pull tab connected to the slider body. The slider body slides back and forth in response to a manual force imposed from the pull tab to mesh together or separate the teeth of the chain as the case may be in a conventional manner. The chain teeth of the zipper 74 are located to mesh between the edge of the underside panel 72 and inside facing side of the base of the lip. Thus, one half of the chain teeth are attached to the edge of the underside panel 72 and the remaining half of the chain teeth are attached to the inside facing side of the base of the lip 62. Depending upon the arrangement, the chain teeth may extend along two, three or four inside facing sides of the base of the lip 62 and along complementary edges of the underside panel 72. As shown in FIG. 10, where the zipper 74 can open along three sides of the underside panel 72, the remaining side can be pivoted so that the underside panel 72 in effect becomes a flap. With the flap open, the mattress 50 can be passed into or out of the mattress cover 52.

With the mattress 50 inside confines of the mattress cover 52 and the recessed cavity 60 accommodating within the adjustable mechanism 10, an underside of the mattress cover has an outer peripheral edge where the lip 62 projects downward and is adjacent to the outer peripheral edge. The lip 62 may extend in a discontinuous manner and in that sense extends about the outer peripheral edge of the mattress cover by less than an entirety of the outer peripheral edge. Such discontinuity provides for openings or gaps to accommodate placement of the DC power cord 11. Alternatively, the lip 62 may extend in a continuous manner but have sections that have a smaller height than the rest of the lip 62 so as to define one or more recesses (e.g., gaps) to accommodate placement of the DC power cord 11.

The lip 62 may define only a single pair of opposite walls 61 of the recessed cavity 60 with no further walls between the single pair. Alternatively, the lip 62 may define that single pair 61 and another wall 61 that extends between the single pair, but no further wall between the single pair 61. Otherwise, the lip 62 may define two pairs of opposite walls 61 of the recessed cavity 60.

There may be a risk that the lip 62 may not be enough to prevent all types of mattresses from sliding off the end of the adjustable mechanism 10 when the head side is raised (i.e., performing the function of the typical mattress retainer bar at the foot). This is probably a larger concern when no weight is on the mattress. Thus, it is preferred that some form of fastening be provided to deter the mattress from sliding off. This form of fastening can be broad sections of hook-loop (VELCRO type) material glued or sewn to the mattress cover 52 that fastens to the adjustable mechanism 10, or even providing for mating snaps, or straps, or clamps to effect the fastening of the mattress cover 52 to the adjustable mechanism 10. To enable the easy placement of a fitted sheet onto the mattress, the fastening method may include a mechanism to allow the fasteners to lift or release when the bed is in a flattened state, while still holding the mattress in place without user intervention when the bed adjusts into an articulated state.

Figure 14:
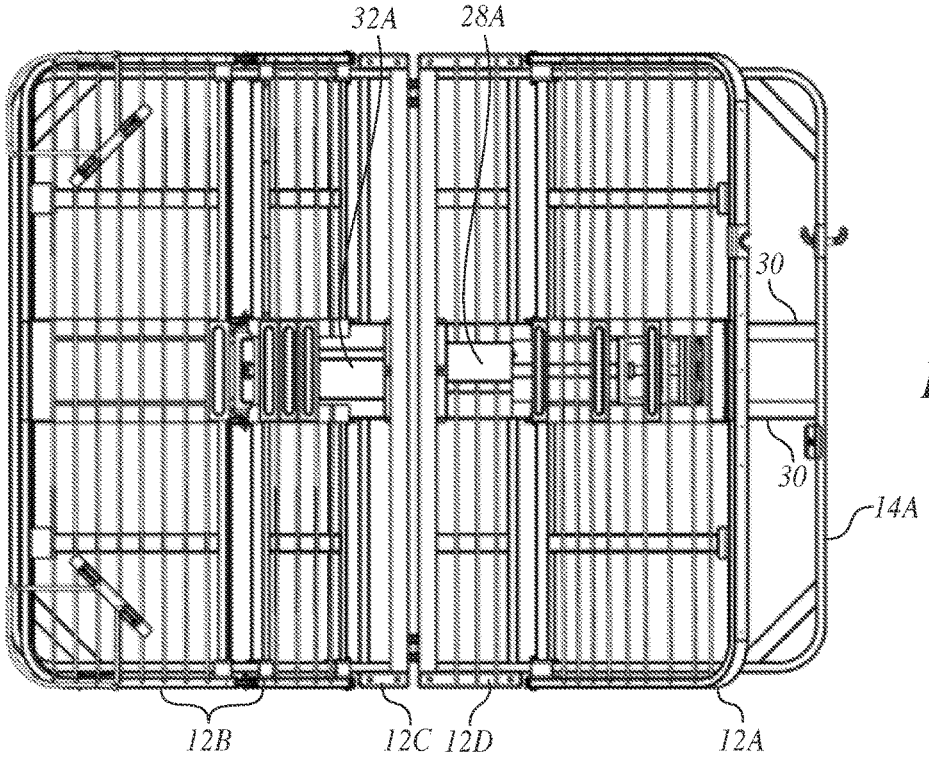
FIG. 14 is a top view thereof.
Figure 15:
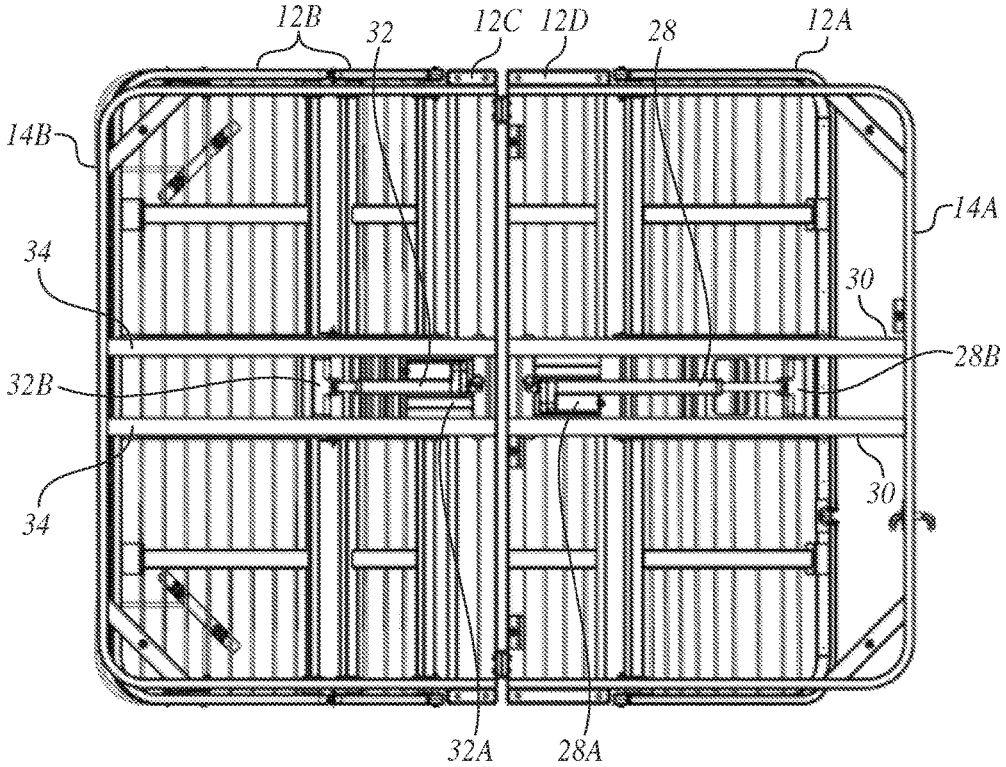
FIG. 15 is a bottom view thereof.
Figure 16:
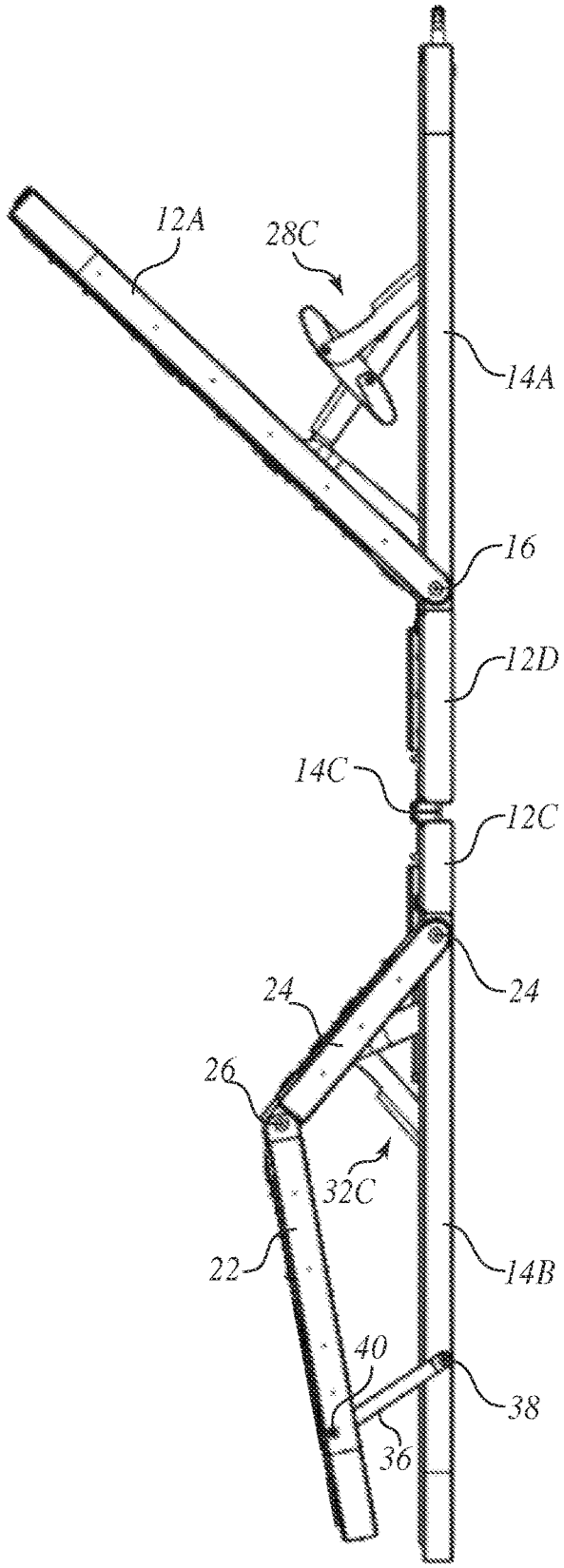
FIG. 16 is a right side view thereof, which is symmetric to the left side view thereof.
Figure 19:
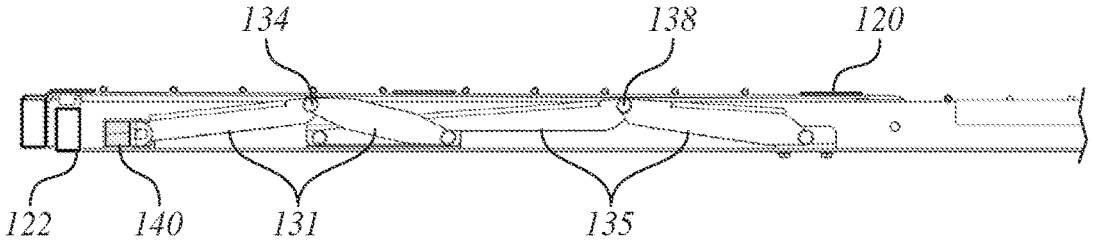
FIG. 19 is an elevation view of a flattened state of the bed lift of FIG. 14 in accordance with the eight-bar articulated linkage embodiment.

For the sake of brevity, the drawings do not show the adjustable mechanism 10 in its actuated positions shown in FIGS. 13, 16, 20 and 22 of U.S. Pat. No. 10,463,163 B1 although FIGS. 14, 15 and 19 of U.S. Pat. No. 10,463,163 B1 are reproduced as FIGS. 10, 11 and 12 respectively, but any of such actuated positions may arise with the mattress cover 52 on top. By so doing, portions (see head-side stationary frame 14A and foot-side stationary frame 14B (FIGS. 10-13)) of the adjustable mechanism 10 may become visible underneath the mattress cover 52 because of the head and foot of the mattress 50 becoming elevated, but the actuated portions (see head-side articulating frame 12A and foot-side articulating frame 12B (FIGS. 10-13)) remain hidden within the recessed cavity 60. Maintenance of the adjustable mechanism 10 may be carried out in the same manner as set forth in U.S. Pat. No. 10,143,163 B1 by providing access to it upon removal of the mattress cover 52 from the adjustable mechanism 10. Likewise, for the sake of brevity, only some of the drawings of the adjustable bed lift mechanism of U.S. Pat. No. 10,376,074 B2 are reproduced.

The adjustable mechanism 10 in FIGS. 13-16 may have two support frames, namely, an outer frame and an inner frame. The outer frame includes a head-side articulating frame 12A, a foot-side articulating frame 12B and two center frames 12C, 12D. The inner frame includes a head-side stationary frame 14A and a foot-side stationary frame 14B that are pivotally connected to each other via hinges 14C.

There are folding hinges 16 between one of the two center frames 12D and the head-side articulating frame 12A. There are folding hinges 18 between the foot-side articulating frame 12B and the other of the two center frames 12C. The foot-side articulating frame 12B has two sections 22, 24 between which are folding hinges 26. Folding hinges 16, 18 and 26 each axially connect the outer frame to the inner frame. There are also links 36 pivotally connected via hinges 38 to the foot-side stationary frame 14B and via hinges 40 to the section 22 of the foot-side stationary frame 12B.

There is also a head-side actuator 28 that includes a head-side motor 28A that imparts a force to drive a head-side sliding member 28B (such as a pull bar) to slide back and forth along a track 30. There is a head-side connected structure 28C that operatively connects pivotally the head-side sliding member 28B and the head-side articulating frame 12A. Thus, the head-side connected structure 28C moves in unison with the head-side driven member 28B to pivot the head-side articulating frame 12A about the folding hinges 16 to travel between its flattened and adjusted states.

There is also a foot-side actuator that includes a foot-side motor 32A that imparts a force to a foot-side sliding member (such as a pull bar) to slide back and forth along a track 34. There is a foot-side connected structure 32C that operatively connects pivotally the foot-side sliding member 32B and the foot-side articulating frame 12B. Thus, the foot-side connected structure 32C moves in unison with the foot-side sliding member 32B to pivot the foot-side articulating frame 12B about the folding hinges 18 to travel between its flattened and adjusted states. Such pivoting action about the folding hinges 18 also result in pivoting action about the hinges 26 because the foot-side articulating frame 12B has the two sections 22, 24 pivotally connected to each other at the hinges 26, with section 22 pivotally connected via the hinges 40 to the links 36, which are pivotally connected via the hinges 38 to the foot-side inner frame 14B.

The outer frame nests about the inner frame. The actuators 28 and 32 remain within a height of the inner frame during an entirety of the sliding movements of the respective head-side and foot-side connected structures in the respective tracks 30, 34. That is, the actuators 28 and 32 remain within confines of a volume defined between upper and lower planes of the articulated bed frame and bounded on the sides and ends by the outer and inner frames 12, 14 of adjustable mechanism 10. During an entirety of a lifting movement of the articulating frame, the associated actuator remains above the lower plane of the adjustable mechanism 10.

The inner frame 12 folds in half at the folding hinges 16, without requiring the use of tools to do so. The actuators 28, 32 remain in the same plane as the inner frame 14 in its flattened condition throughout the lifting procedure for the mattress. As an alternative, the actuators 28, 32 each start flat within the same plane as the inner frame 14 and then raise slightly above the plane of the inner frame 14 during the lifting procedure.

Figure 17:
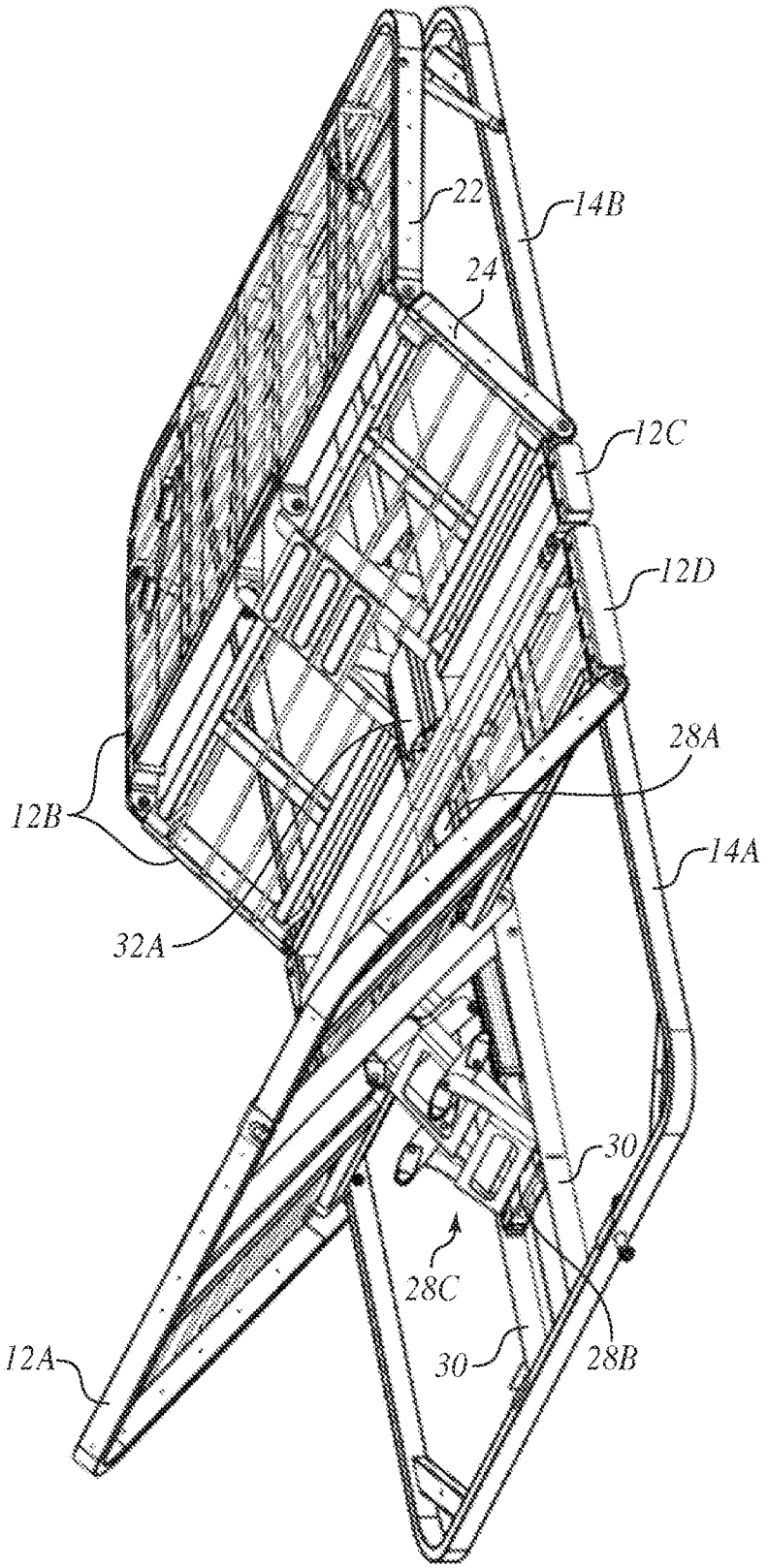
FIG. 17 is a reverse isometric view to that of FIG. 10.
Figure 18:
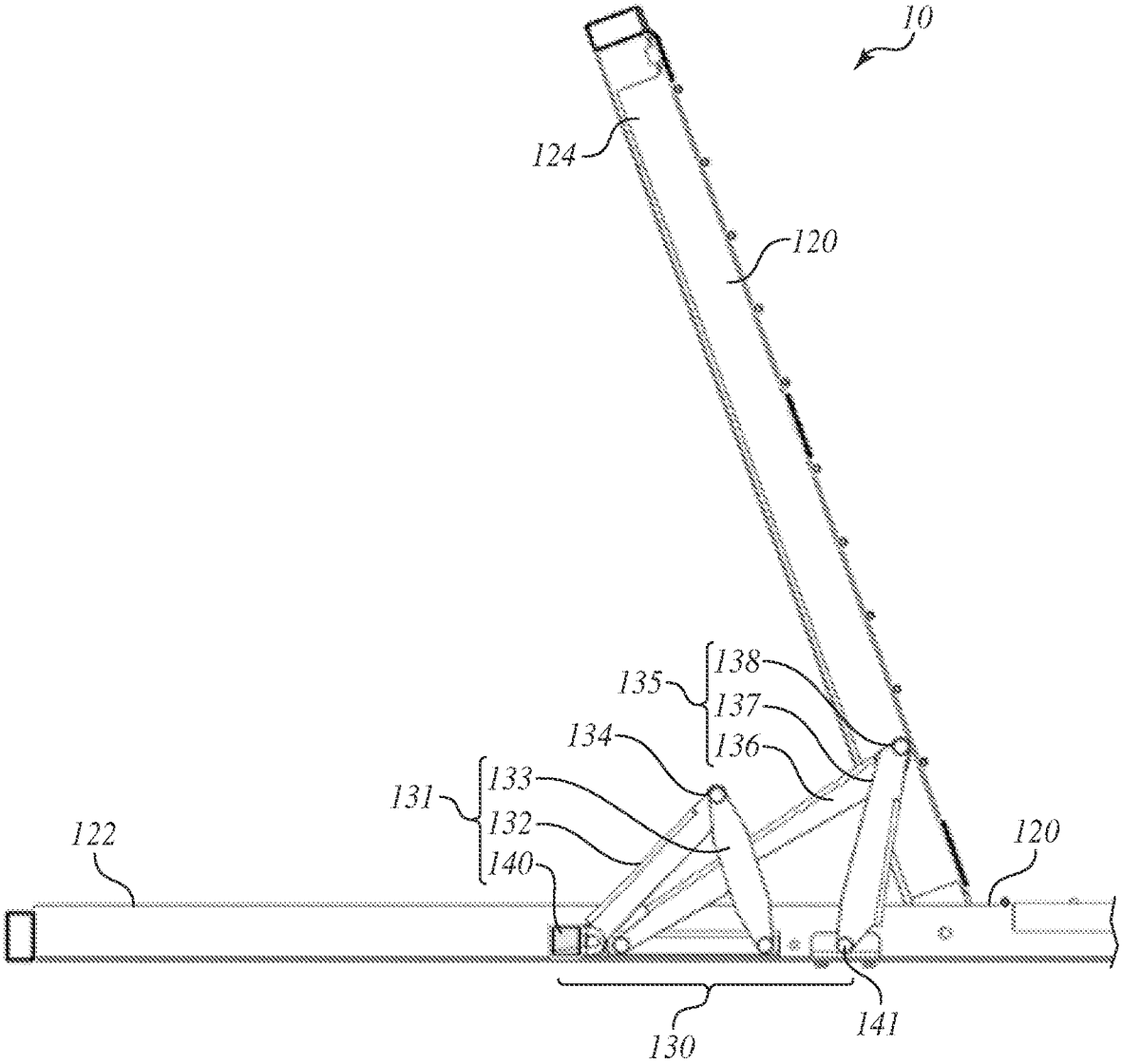
FIG. 18 is a cross section of a bed frame together with an elevation view of a bed lift having an articulated linkage system in the bed frame in accordance with an eight-bar articulated linkage embodiment.

The basic principle behind the concept of the power layer of FIGS. 17 and 18 rests on a multi-stage mechanism concept that enables the actuator to be placed in parallel or near parallel with the mattress surface, while still transmitting sufficient force to lift the bed. This allows the power layer to achieve its unprecedented thin profile.

The lifting mechanism of the power layer includes a first stage and second stage mechanism tied to a single actuator. The first stage mechanism is optimized to lift the bed from flat up to a certain distance and angle. As a result, an angle of inclination between the articulating portion 124 of the bed frame 120 and the fixed portion 122 of the bed frame 120 widens as the actuator connected structure moves from its non-actuated position to its first-stage actuated position.

This first stage is designed to most efficiently transmit maximum force from the actuator to the bed while the bed is nearly flat or only partially lifted. However, the limitation of this optimization is that the first stage cannot complete the full travel lifting of the bed, which typically would be 60 to 70 degrees for the head section.

Once that maximum lifting angle is achieved by the first stage, a second stage mechanism that is optimized to lift the bed past maximum first stage angle takes over that lifts the bed the remainder of its intended travel. The second stage mechanism is optimized for lifting once the bed has already been lifted to the angle of the first stage mechanism. As a result, the angle of inclination between the articulating portion 124 of the bed frame 120 and the fixed portion 122 of the bed frame 120 further widens as the actuator connected structure 140 moves from its first-stage actuated position to its second-stage actuated position. The actuator connected structure pulls a "pull-bar 140", which connects to the linkages. The pull-bar 140 travels along a channel in the fixed portion of the bed frame and has a smooth and continuous movement, allowing infinite number of bed articulated positions.

There is an eight-bar articulated linkage 130 in the bed frame 120. The bed frame 120 includes a fixed (inner) portion 122 and an articulating (outer) portion 124 that are pivotally attached to each other. There are first- and second-stage lift mechanisms 131, 135 that are actuated respectively by moving the pull bar 140 to the actuator connected structure accordingly from a non-actuated position to a first-stage actuated position that actuates the first-stage lift mechanism 131 and then to a second-stage actuated position that actuates the second-stage lift mechanism 135. The pull bar 140 to actuator connected structure may pulled to move its actuator or alternatively pushed.

The first-stage lift mechanism 131 includes articulated linkages 132, 133, which pivot about a first-stage lift pivot 134 and are pivotally connected to the fixed (inner) portion 122 of the bed frame 120. The second-stage lift mechanism 135 includes the articulated linkages 36, 137, which pivot about a second-stage lift pivot 138 and are pivotally connected to the fixed (inner) portion 122 of the bed frame 120. For instance, the linkage 137 is pivotally connected at one end to the bed frame 120 at pivot 141.

If desired, the adjustable mechanism may be equipped an elongated stationary frame from which legs extend downwardly. The legs may be permanently fixed or may instead be pivoted to move between a stowed position (extending adjacent the frame, such as in the same plane of the frame) and an actuated position (extending perpendicular to the frame to extend downwardly). The elongated stationary frame may be pivotally connected to the two articulated frames.

While the foregoing description and drawings represent the preferred embodiments of the present invention, it will be understood that various changes and modifications may be made without departing from the scope of the present invention.

What is claimed is:

1. A product upon which a person may lie down, comprising:

a mattress;

a mattress cover that has a fabric layer that forms a configuration that is fit onto the mattress to envelop the mattress and also forms a lip that is arranged to project outward from outer peripheral regions of the mattress to define opposite walls of a recessed cavity;

an adjustable mechanism that is both within the recessed cavity and outside the confines of the mattress cover, the lip overlapping sides of the adjustable mechanism that are within the recessed cavity so as to conceal the sides because of the overlapping of the lip with the sides, the adjustable mechanism having a stationary frame and at least one articulating frame that are pivotally connected to each other, the at least one articulating frame being configured to pivot relative to the stationary frame between lowered and raised conditions that cause the mattress to flex.

2. The product of claim 1, wherein the at least one articulating frame includes two articulating frames each configured to move between the lowered and raised conditions, the two articulating frames extending flat relative to each other in the lowered condition, the two articulating frames extending at different angles of inclination relative to each other in the raised condition which causes head and foot regions of the mattress incline accordingly relative to a central region of the mattress that is between the head and foot regions.

3. The product of claim 1, wherein the opposite sidewalls include a pair of gaps, further comprising:

a power cord that extends through one of the gaps from within the recessed cavity to outside the recessed cavity, the power cord conveying electricity to the adjustable mechanism to power same.

4. The product of claim 1, wherein the two articulating frames are each pivotally movable relative to a stationary frame and separated from each other by the stationary frame, the stationary frame remaining stationary during both the lowered and raised conditions of the articulated frames.

5. The product of claim 1, wherein the lip contains filler material in contact with the fabric layer, the fabric layer being of a different material than that of the filler material.

6. The product of claim 1, wherein an underside of the mattress cover has an outer peripheral edge, the lip extending in a discontinuous manner adjacent to the outer peripheral edge of the underside of the mattress so that a total length of the is less than an overall length of an entirety of the outer peripheral edge of the underside of the mattress.

7. The product of claim 6, wherein the lip is constituted by only a single pair of the opposite walls with no further walls extending between the single pair.

8. The product of claim 6, wherein the lip is constituted only by a single pair of the opposite walls and by another wall that extends between the opposite walls so that the lip has a total of three walls.

9. The product of claim 1, wherein the fabric layer of the lip of the mattress cover encloses an internal cavity that contains filler material, the fabric layer having a portion beneath an underside of the mattress that is abutted by the adjustable mechanism.

10. The product of claim 1, wherein the adjustable mechanism is configured in a manner that is operative to pivot between articulated and non-articulation positions such that in the non-articulated position, both the stationary frame and the at least one articulating frame are within the recessed cavity and in the articulated position, only the at least one articulating frame remains within the recessed cavity and the stationary frame is out of the recessed cavity.

11. A method of assembling a product upon which a person may lie down, comprising:

fitting a configuration, which is formed by a fabric layer of a mattress cover onto a mattress so as to envelop the mattress with the mattress cover and projecting outward a lip, which is also formed by the fabric layer, from outer peripheral regions of the mattress to define opposite walls of a recessed cavity; and placing an adjustable mechanism to be both within the recessed cavity and outside the confines of the mattress cover, the lip overlapping sides of the adjustable mechanism that are within the recessed cavity so as to conceal the sides because of the overlapping of the lip with the side, the adjustable mechanism having a stationary frame and at least one articulating frame that are pivotally connected to each other, the at least one articulating frame being configured to pivot relative to the stationary frame between lowered and raised conditions that cause the mattress to flex.

12. The method of claim 11, wherein the at least one articulating frame includes two articulating frames each configured to move between the lowered and raised conditions, the two articulating frames extending flat relative to each other in the lowered condition, the two articulating frames extending at different angles of inclination relative to each other in the raised condition which causes head and foot regions of the mattress to incline accordingly relative to a central region of the mattress that is between the head and foot regions.

13. The method of claim 11, wherein the opposite walls include a pair of gaps, further comprising:

extending a power cord through one of the gaps from within the recessed cavity to outside the recessed cavity, the power cord conveying electricity to the adjustable mechanism to power same.

14. The method of claim 11, wherein the two articulating frames each pivotally are movable relative to a stationary frame and separated from each other by the stationary frame, the stationary frame remaining stationary during both the raised and lowered conditions of the articulated frames.

15. The method of claim 11, wherein the lip contains filler material in contact with the fabric layer, the fabric layer being of a different material than that of the filler material.

16. The method of claim 11, wherein an underside of the mattress cover has an outer peripheral edge, further comprising:

extending the outwardly projecting lip in a discontinuous manner adjacent to the outer peripheral edge of the underside of the mattress so that a total length of the lip is less than an overall length of an entirety of the outer peripheral edge of the underside of the mattress.

17. The method of claim 16, wherein the lip is constituted by only a single pair of the opposite walls with no further sidewalls extending between the single pair.

18. The method of claim 17, wherein the lip is constituted by only a single pair of the opposite walls and by another wall that extends between the opposite sidewalls so that the lip has a total of three walls.

19. The method of claim 11, further comprising:

containing filler material within an internal cavity enclosed by the fabric layer of the lip of the mattress layer, and abutting a portion of the fabric layer beneath an underside of the mattress with the adjustable mechanism.

20. The method of claim 11, wherein the adjustable mechanism is operative to pivot between articulated and non-articulation positions such that in the non-articulated position, both the stationary frame and the at least one articulating frame are within the recessed cavity and in the articulated position, only the at least one articulating frame remains within the recessed cavity and the stationary frame is out of the recessed cavity.

* * * * *